US010283053B2

(12) United States Patent
Pappas et al.

(10) Patent No.: US 10,283,053 B2
(45) Date of Patent: May 7, 2019

(54) DISPLAY WITH CELL VOLTAGE COMPENSATION

(71) Applicant: Facebook Technologies, LLC, Menlo Park, CA (US)

(72) Inventors: Ilias Pappas, Cork (IE); Sean Lord, Ottawa (CA); Yu-Hsuan Li, Hsinchu (TW)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/480,254

(22) Filed: Apr. 5, 2017

(65) Prior Publication Data

US 2017/0301296 A1 Oct. 19, 2017

(51) Int. Cl.
*G09G 3/3266* (2016.01)
*G09G 3/3291* (2016.01)
(Continued)

(52) U.S. Cl.
CPC ..... *G09G 3/3266* (2013.01); *G09G 3/2011* (2013.01); *G09G 3/2014* (2013.01); *G09G 3/3233* (2013.01); *G09G 3/3291* (2013.01); *G09G 2300/043* (2013.01); *G09G 2300/0809* (2013.01); *G09G 2300/0819* (2013.01); *G09G 2300/0842* (2013.01);
(Continued)

(58) Field of Classification Search
CPC .. G09G 3/3266; G09G 3/2014; G09G 3/3291; G09G 3/2011; G09G 3/3233; G09G 2300/0819; G09G 2330/08; G09G 2300/0842; G09G 2300/0809; G09G 2300/043; G09G 2320/0252; G09G 2330/10
See application file for complete search history.

(56) References Cited

U.S. PATENT DOCUMENTS 6,677,713 B1 * 1/2004 Sung ..... G09G 3/3233 315/169.1
7,642,997 B2 * 1/2010 Hamer ..... G09G 3/3233 345/76
(Continued)

OTHER PUBLICATIONS

GB Combined Search and Examination Report Under Sections 17 and 18(3), GB Application No. 1606517.9, dated Oct. 11, 2016, 5 pages.

*Primary Examiner* — Jose R Soto Lopez
(74) *Attorney, Agent, or Firm* — Fenwick & West LLP

(57) ABSTRACT

An active matrix display wherein each cell comprises: two thin-film transistors (TFTs) connected in series, the first TFT having its drain connected to a high supply line and the second TFT having its source connected to a low supply line. Gates of the first and second TFTs are selectively connected to respective first and second data driver signals under the control of a scan line signal. A storage capacitance is connected to a node joining the first and second TFT. A driving TFT has a gate connected to the joining node and is connected to drive a light emitting device with a bias current. In one embodiment, the first and second TFTs are sized relative to one another and the first and second data driver signal voltages are related proportionally, so that the data driver signals and the bias current are related to one another by a function substantially independent of a threshold voltage of the driving TFT.

18 Claims, 5 Drawing Sheets

(51) Int. Cl.
*G09G 3/20* (2006.01)
*G09G 3/3233* (2016.01)

(52) U.S. Cl.
CPC . *G09G 2320/0252* (2013.01); *G09G 2330/08* (2013.01); *G09G 2330/10* (2013.01)

(56) References Cited

U.S. PATENT DOCUMENTS

| | | | | |
|---|---|---|---|---|
| 9,728,127 | B2 * | 8/2017 | In | G09G 3/3233 |
| 9,934,725 | B2 * | 4/2018 | Chaji | G06F 1/3218 |
| 2009/0315874 | A1 * | 12/2009 | Kim | G09G 3/3233 345/213 |
| 2015/0145851 | A1 * | 5/2015 | Takeda | G09G 3/3233 345/212 |
| 2016/0268364 | A1 * | 9/2016 | Yin | G09G 3/3233 |
| 2016/0358533 | A1 * | 12/2016 | Rotzoll | G09G 3/32 |
| 2016/0379553 | A1 * | 12/2016 | Cho | G09G 3/3233 345/76 |
| 2017/0025075 | A1 * | 1/2017 | Cok | H05B 33/0806 |
| 2017/0061842 | A1 * | 3/2017 | Cok | G09G 3/2003 |
| 2017/0193912 | A1 * | 7/2017 | Choi | G09G 3/3258 |
| 2018/0005565 | A1 * | 1/2018 | Rotzoll | G09G 3/32 |

* cited by examiner

DISPLAY WITH CELL VOLTAGE COMPENSATION

PRIORITY CLAIM

This application claims the benefit of United Kingdom Patent Application No. 1606517.9, filed Apr. 14, 2016, which is incorporated by reference in its entirety.

FIELD

The present invention relates to a display and a method of driving a display.

BACKGROUND

Displays are ubiquitous and are a core component of every wearable device, smart phone, tablet, laptop, desktop, TV or display system. Common display technologies today range from Liquid Crystal Displays (LCDs) to more recent Organic Light Emitting Diode (OLED) displays.

Referring now to FIG. 1, there are shown an active drive matrix for a display. The matrix comprises N rows of cells divided into M columns. Each cell includes a light emitting device corresponding to either: a pixel for a monochrome display; or one of a red, green or blue sub-pixel within a color display. For color displays either: differently colored sub-pixels can be interleaved along rows of the matrix; or respective rows of the matrix can comprise only sub-pixels of a given colour.

A plurality of peripheral driving blocks comprise:

Scan driver—which produces pulsed signals S1 . . . Sn enabling respective rows of the matrix to be programmed for a subsequent frame or sub-frame; and Data driver—which delivers data outputs D1 . . . Dm to program individual cells of a row enabled by the scan driver—these signals are updated for each frame or sub-frame from scan line to scan line.

In some matrices, a constant supply voltage (Vdd) is provided to each cell of the matrix to drive the light emitting device during a frame according to the cell programming. Typically, for a constant supply voltage (Vdd) implementation, the data driver provides analog outputs which determine the brightness of a cell for a subsequent frame.

In the matrix of FIG. 1, a PWM (Pulse Width Modulation) Driver produces PWM pulses used to bias programmed cells enabling the cells to emit light or not during a sub-frame according to their programming. (Note that the term "PWM" is used in the present description to relate to pulsed signals for activating cells within a row—such pulses may be employed as part of a conventional PWM addressing scheme, such as described in WO2010/014991 or a color sequential scheme, such as described in WO2014/012247.) For PWM, the data driver typically provides digital outputs with the PWM driver providing variable width pulses which in combination with the cell programming for a sub-frame determines the brightness of a cell for a frame.

UK Patent Application No. 1604699.7 (Ref: 135-1702-01GB) filed 21 Mar. 2016 discloses a hybrid scheme where the data driver provides combinations of analog or digital outputs limiting the switching frequency required of the PWM driver.

In FIG. 1, two synchronization blocks are employed: one located between the scan driver and data driver in order to ensure that the required data signals are delivered after a scan pulse is applied to a row; and a second between the data and PWM drivers to ensure that PWM pulses are applied when data loading is completed.

Each row within the matrix is addressed with a respective scan line S1 . . . Sn which goes high or is asserted when a respective row of the display is to be addressed (or programmed) by the data driver for the subsequent frame or sub-frame. For PWM, during a given frame, for each row, the PWM driver provides a sequence of driving pulses using respective PWM signals P1 . . . Pn. Each signal P can be a time shifted version of the adjacent PWM signal synchronized with the scan line signals S1 . . . Sn and data driver signals D1 . . . Dm.

Active matrix circuitry, for example, as described in WO2010/119113, uses thin film transistor technology (TFT), where cells comprise transistors based on amorphous, oxide or polycrystalline silicon technology manufactured on a glass substrate ranging in size from 30 cm×40 cm to the latest generation (known as GEN10) of 2.88 m×3.15 m. The TFTs are used either as voltage switches or current sources to control the operation of light emitting devices within each cell.

In most portable, typically battery powered, devices, the display uses the majority of the available power. The most common user complaint for portable devices is insufficient display brightness. To extend battery life and improve brightness levels it is necessary to develop new display technologies that reduce power consumption and produce higher luminance emission from the light source.

WO2013/121051 discloses an improved light emitting device for a display, referred to as an integrated or inorganic LED (iLED) which comprises a substrate with a semiconductor material comprising a light generating layer positioned on the substrate. The semiconductor material and/or the substrate are configured to control light internally to output quasi-collimated light from a light emitting surface of the iLED. The iLED comprises an optical component positioned at the light emitting surface and configured to receive quasi-collimated light exiting the light emitting surface and to alter one or more optical properties of at least some of the quasi-collimated light.

Whereas OLED cells operate by passing current through organic or polymer materials sandwiched between two glass planes to produce light; iLED displays replace the OLED material with discrete LED die (which is made of inorganic materials) placed at each cell of the display.

Nonetheless, both OLED and iLED cells are current driven. This means that their emitted brightness is controlled by the current that flows through them, so the stability of the biasing current across the display will determine the uniformity of light emitted from the display.

Referring now to FIG. 2, a typical 2-TFT-1-capacitance (2T1C) pixel design for a constant supply (i.e. non-PWM) active matrix display is shown. In this case, T1 acts as a switch and T2 is the driving TFT that produces the bias current for the light emitting device. During a frame programming period, the scan signal goes high "1" and T1 is turned ON and the storage capacitance Cst is charged up to Vdata—the voltage provided by the data driver. T2 operates within its saturation region and the voltage at node A (which is equal to Vdata) is its gate voltage. Therefore, its drain current and bias current will be:

$$I_{drain} = I_{bias} = \frac{W}{L}\mu C_{ox}(V_{gs,T2} - V_{th})^2 \quad (1)$$

where W and L are the gate width and length, respectively, μ is the carriers mobility, Cox is the gate-oxide capacitance, Vgs is the gate-to-source voltage and Vth is the threshold voltage of the TFT device. Another way of expressing the above is:

$$I_{bias} = k(V_{data} - V_{th})^2, \text{ where } k = \frac{W}{L}\mu C_{ox} \tag{2}$$

As indicated above, TFT devices can be either amorphous silicon (a-Si), Indium-Gallium-Zinc-Oxide (IGZO), Low-Temperature polycrystalline silicon (LTPS) or organic (OTFTs). Depending on the fabrication process, threshold voltage variations occur either during fabrication (LTPS) or during operation, under positive bias stress (A-Si, IGZO, OTFT). The threshold voltage variation can be regarded as a completely random process and can exist even for TFT devices fabricated on the same substrate.

Thus, for a display where cells are programmed with the same Vdata during the frame refresh so that two cells might emit the same grey scale (same light brightness), their driving TFTs can have different threshold voltages. The produced bias current will be different since Vth1≠Vth2→Idrain1≠Idrain2, resulting in different emitting brightness. This non-uniformity of brightness caused by threshold voltage variations of the TFT is called mura effect.

SUMMARY

According to a first aspect, there is provided a display according to claim 1.

In embodiments, by choosing an appropriate set of driving signals, as well as TFT dimensions, threshold voltage compensation and data loading can occur during the same phase.

Thus, no separate phase for threshold voltage extraction is needed, resulting in a very fast programming phase. Embodiments are therefore suitable for high performance displays with high frame rate and short programming time.

The cell design can be used for both OLED and iLED high performance displays with high frame rate and short programming time.

According to a second aspect, there is provided a display according to claim 8.

In the second aspect, each cell is arranged to accommodate at least two discrete light emitting devices. Changing the value of the data voltage relative to a bias voltage, determines which, if any, light emitting device will emit light.

A repair mode can be implemented where the data voltage is set so that none of the light emitting devices will emit light and so the cell turns black leaving surrounding pixels to determine the display image. This repair mode can be used, if both placed light emitting devices are identified as defective.

In embodiments, one light emitting device is connected to a p-type TFT and a second is connected to an n-type TFT. By controlling the data and bias voltages (Vdata, Vbias), the sign of the driving voltage is set, determining which of the p or n-type TFT will be turned ON and consequentially which light emitting device will emit light.

BRIEF DESCRIPTION OF THE DRAWINGS

Embodiments of the invention will now be described, by way of example, with reference to the accompanying drawings, in which.

DESCRIPTION OF THE EMBODIMENTS

In embodiments of the present invention, compensation for threshold voltage variation is provided locally on a cell by cell basis. If the threshold voltage of the driving TFT, T2, is extracted and added to Vdata, then the effective gate voltage of the driving TFT would be:

$$V_{gs,eff} = V_{data} + V_{th} \tag{3}$$

In this case, the produced drain current would be:

$$I_{drain} = I_{bias} = \frac{W}{L}\mu C_{ox}(V_{gs,eff,T2} - V_{th})^2 \rightarrow I_{bias} = \frac{W}{L}\mu C_{ox}(V_{data})^2 \tag{4}$$

As it can be seen from Equation (4), the produced drain current that would bias the light emitting device would then be independent of the driving TFT threshold voltage and the light brightness would exhibit immunity to the threshold voltage variations.

Figure 3:
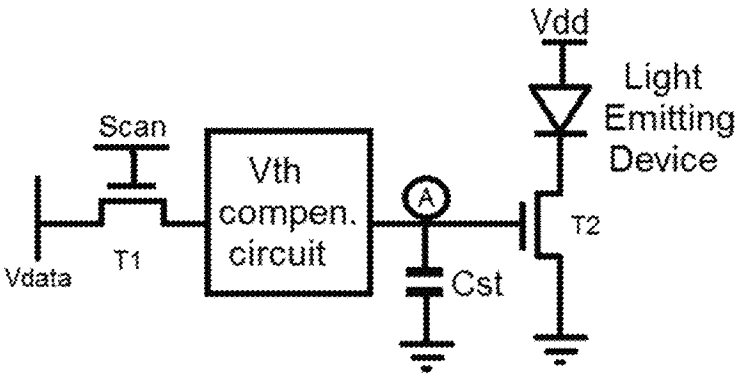
FIG. 3 shows a pixel design with threshold voltage compensation.
Figure 2:
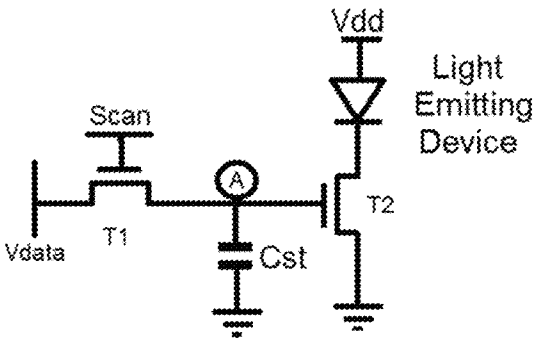
Figure 2 (Prior Art)
FIG. 2 shows a conventional 2-TFT-1-capacitance pixel design.

Referring now to FIG. 3 which shows a notional circuit implementation of the above method. According to FIG. 3, an additional Vth compensation circuit is added to the 2T1C cell. During the frame programming phase and before the data loading period, the circuit samples the threshold voltage of the driving TFT, T2 and then it sums the extracted threshold voltage and the Vdata in order to generate the required effective gate-to-source voltage for compensation. Therefore, a specific time duration of the scan pulse per frame refresh period is dedicated to threshold voltage compensation. An example of such scan pulses is shown in FIG. 4.

The total scan pulse duration ($\tau_{scan}$) depends on the frame rate (FR) of the display as well as from the total number of rows (Nrow), and can follow the equation:

$$\tau_{scan} = \frac{1}{FR * N_{row}}$$

Figure 4:
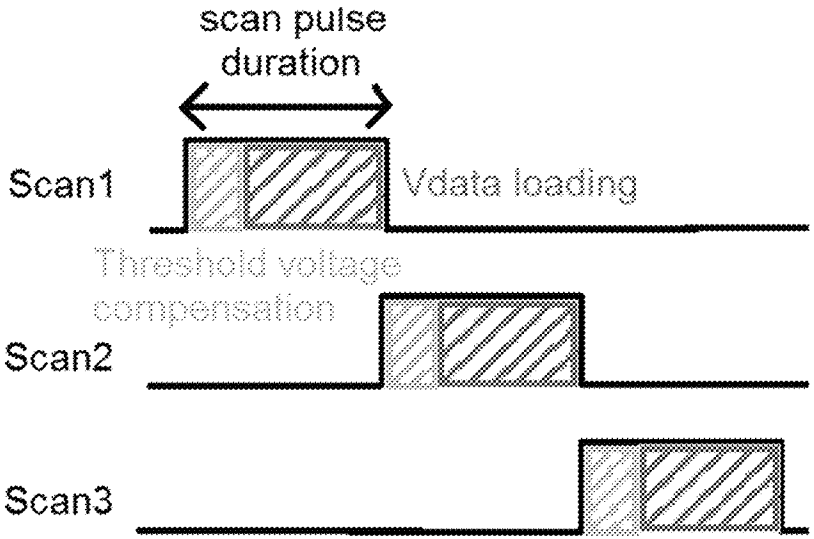
FIG. 4 is a timing diagram showing scan pulses with a threshold voltage compensation phase.

FIG. 4 implies that the total scan time is divided into the threshold voltage compensation phase and the Vdata loading phase. (In the case of a PWM matrix, the period after threshold voltage compensation would comprise both a Vdata loading phase and a PWM phase for each sub-frame.) As the performance, i.e. frame refresh rate, and the size or resolution of displays keeps increasing, the available scan time is reduced significantly. This means that the time for threshold voltage compensation also shrinks, making threshold voltage compensation impractical for high performance displays.

Figure 5:
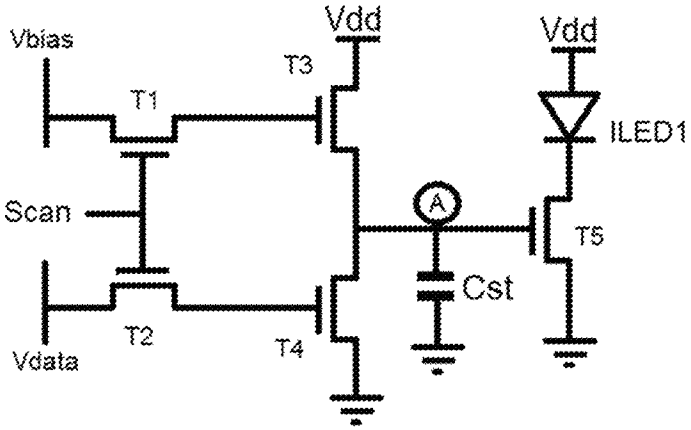
FIG. 5 shows a single LED cell design according to an embodiment of the present invention.

FIG. 5 illustrates a cell design according to an embodiment of the present invention.

Figure 1:
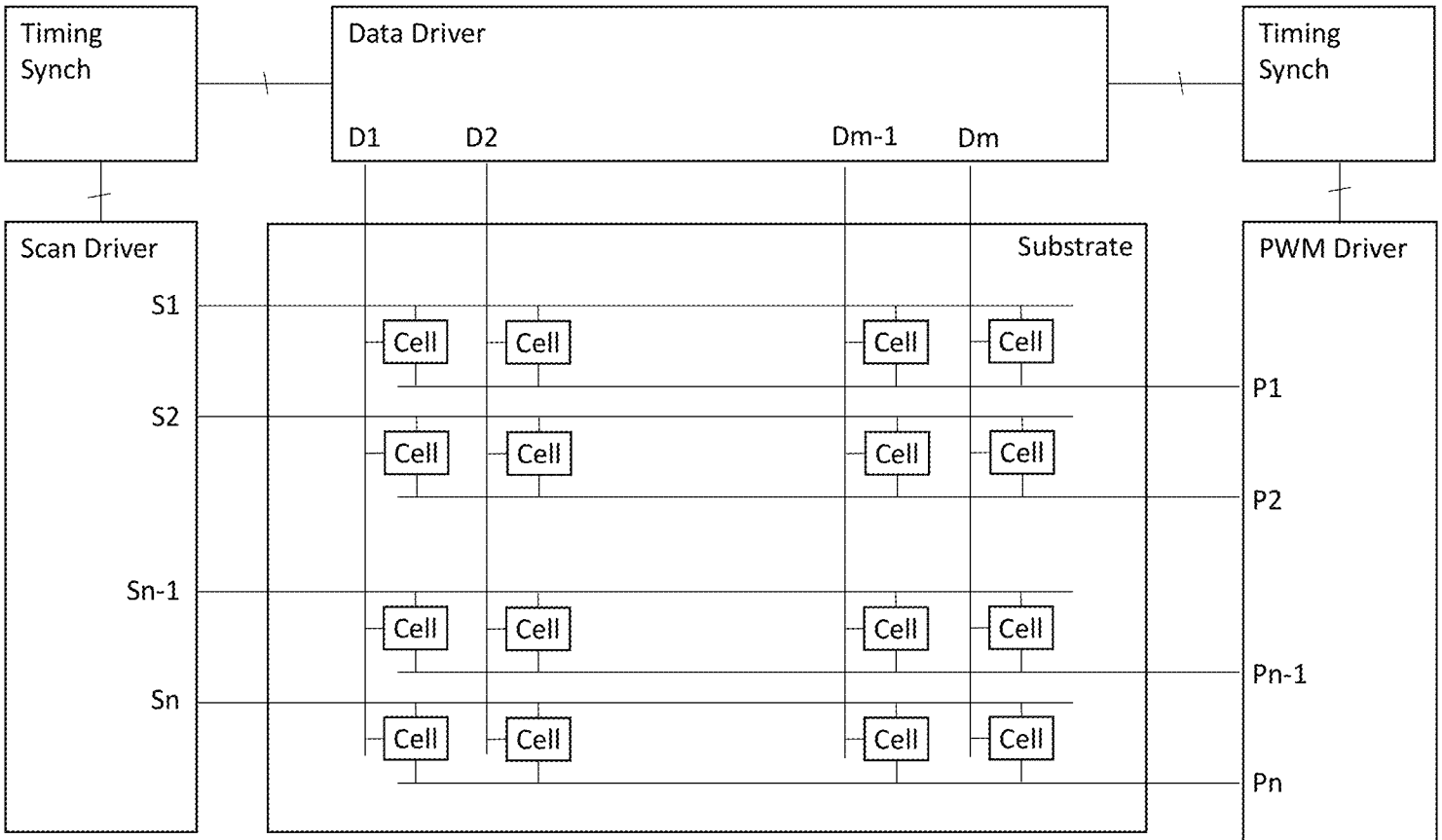
Figure 1 (Prior Art)
FIG. 1 shows a conventional type active matrix display.

The cell comprises 5 TFTs T1 . . . T5 and 1 storage capacitance Cst. The objective is to produce a voltage at the storage capacitance (node A) equal to the effective voltage shown in equation (3). In an embodiment, T4 is four times larger than T3 ($k_4=4k_3$) and the bias voltage (Vbias) is 3 times larger than data voltage (Vbias=3*Vdata) and is provided by the data driver at the same time as Vdata. Thus for a matrix as shown in FIG. 1, each data driver signal D1 . . . . Dn would comprise a data line and bias line, one being a fraction of the other. T3 and T4 share the same current and both of them operate within their saturation region. Therefore:

$$I_{drain,T3}=I_{drain,T4}\rightarrow k_3(V_{gs,T3}-V_{th3})^2=k_4(V_{gs,T4}-V_{th4})^2$$

$$k_3(3*V_{data}-V_A-V_{th3})^2=4k_3(V_{data}-V_{th4})^2$$

$$3*V_{data}-V_A-V_{th3}=2*V_{data}-V_{th4}$$

If it is assumed that the two TFTs (T3 and T4) share the same threshold voltage (Vth4=Vth3=Vth) which is true, at least for LTPS, the voltage at node A, will be:

$$V_A=V_{gs,T5}=V_{data}+V_{th}$$

Therefore, the bias current produced from T5, is threshold voltage independent and well controlled, since it will be calculated by the equation:

$$I_{ILED}=\frac{W_5}{L_5}\mu C_{ox}(V_{data})^2$$

As it can be seen from FIG. 3, the frame programming and the threshold voltage compensation can now be implemented during the same phase, resulting in additional available time for the programming phase or for improved performance. Furthermore, in the cell design of FIG. 5, the storage capacitor isn't charged directly from data line, but from T3. This means that power as well as propagation delay can be reduced. The advantages of the described cell design thus make it suitable for high performance displays, with high frame refresh rate and a short scan period.

The only requirement to ensure the proper operation of the cell is that all TFTs operate within their saturation region. The most critical TFT is T3 because its gate node is biased with the highest voltage. The condition which will ensure that T3 operates in its saturation region is:

$$V_{DS,T3}>V_{gs,T3}-V_{th}$$

$$V_{dd}>3*V_{data}-_{th}$$

Therefore, by choosing the supply voltage (Vdd) properly, the operation of the cell is ensured.

It will be appreciated that while the above embodiment has been described with $k_4\times X*k_3$ and Vbias=Y*Vdata; where X=4 and Y=3, any combination of X and Y values which meant that the current through the light emitting device was substantially independent of the driving transistor threshold voltage could be employed.

It will also be appreciated that while a ground reference is shown in FIG. 5, any low supply line voltage could be employed with the above equations changing accordingly.

In operation, during the frame programming phase, the Scan signal for a row containing the cell goes high "1" causing T1 and T2 to turn ON. Vbias and Vdata (provided from the data driver) are biased to the circuit simultaneously, so based on their value, node A voltage and so the ILED current are adjusted. The storage capacitance Cst is added in order to keep the voltage at node A constant during emission phase resulting in stable iLED current. The cell design allows both analog Vdata and PWM driving or mixed mode schemes to be employed. In the case of a PWM driving scheme, rather than providing a constant Vdd to the ilED, a pulsed PWM signal can be applied. Alternatively, as described in UK Patent Application No. 1604699.7 (Ref: I35-1702-01GB), the iLED can be connected to the drain of T5 and the PWM signal can be applied directly to the cathode of the iLED. The mixed mode scheme described in UK Patent Application No. 1604699.7 (Ref: I35-1702-01GB) can also be employed.

Figure 6:
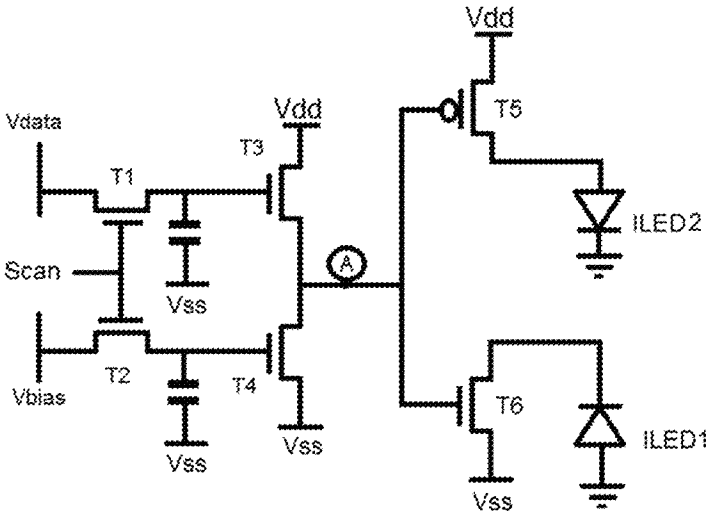
FIG. 6 shows a dual LED cell design according to an embodiment of the present invention.

FIG. 6 illustrates a cell design according to a second embodiment of the present invention including two iLEDs and the front-end part (T1, T2, T3 and T4) of the cell of FIG. 5. The cell design can be used to provide redundancy and so to increase the yield of an iLED based display; or for other applications where it could be useful to swap between driving ILED1 or ILED2 where both are placed in a cell.

The cell of FIG. 6 comprises 6 TFTs T1 . . . T6 and two capacitances. In this case, switching transistors T3 and T4 extend in series between a high supply line Vdd and a low supply line Vss while the capacitors are connected between respective gates of transistors T3 and T4 and ground. ILED1 has its anode connected to the ground line and its cathode connected to the drain node of T6. ILED2 has its cathode connected to ground and its anode connected to the drain node of T5. T5 is a p-type TFT while T6 is an n-type TFT. Again, the operation of the circuit is based on controlling the voltage at node A with T1, T2, T3, T4, Vbias and Vdata so that: if VA>0, T6 operates in order for ILED1 to emit light; or if VA<0, T5 operates in order for ILED2 to emit light. Unlike in FIG. 5, T3 and T4 have the same gate dimensions ($k_3=k_4$) and again, as they are connected in series, the same current flows through them. If both operate in their saturation region, the current will be equal to:

$$I_{drain,T3}=I_{drain,T4}\rightarrow k_3(V_{gs,T3}-V_{th3})^2=k_4(V_{gs,T4}-V_{th4})^2$$

$$k_3(V_{data}-V_A-V_{th3})^2=k_3(V_{bias}-V_{th4})^2$$

$$V_{data}-V_A-V_{th3}=V_{bias}-V_{th4}$$

If it is assumed that the two TFTs (T3 and T4) share the same threshold voltage ($V_{th4}=V_{th3}=V_{th}$) which stands true for LTPS TFT process, the voltage at node A, will be:

$$V_A=V_{data}-V_{bias}$$

Therefore, by setting Vbias at a pre-determined value, the sign of the node A voltage is determined by Vdata independent of the threshold voltage of the driving transistors. If Vdata>Vbias, then VA>0 and ILED1 emits light or if Vdata<Vbias, then VA<0 and ILED2 will emit light. There is also the special case in which Vdata=Vbias resulting in the voltage at node A being equal to zero. In this case none of T5 or T6 will be turned ON so neither ILED1 nor ILED2 will emit light. This can be used for "electrical repair" where no light is emitted from the cell and it is turned into a "black" cell.

Note that in the cell designs of FIGS. 5 and 6, the largest transistor within the cell is T5 and T6, the driving transistor(s). Once such a transistor is being fabricated then there is very little additional cost in producing the switching transistors T1, T2 and indeed the additional switching transistors T3, T4 required for the cell designs of FIGS. 5 and 6.

In the matrix of FIG. 1, the data driver is shown as a singular unit, however, it will be appreciated that the functionality of the data driver (and indeed the other peripheral components) can be divided among more than one unit, for example, with one unit providing Vdata and another providing Vbias.

Figure 7:
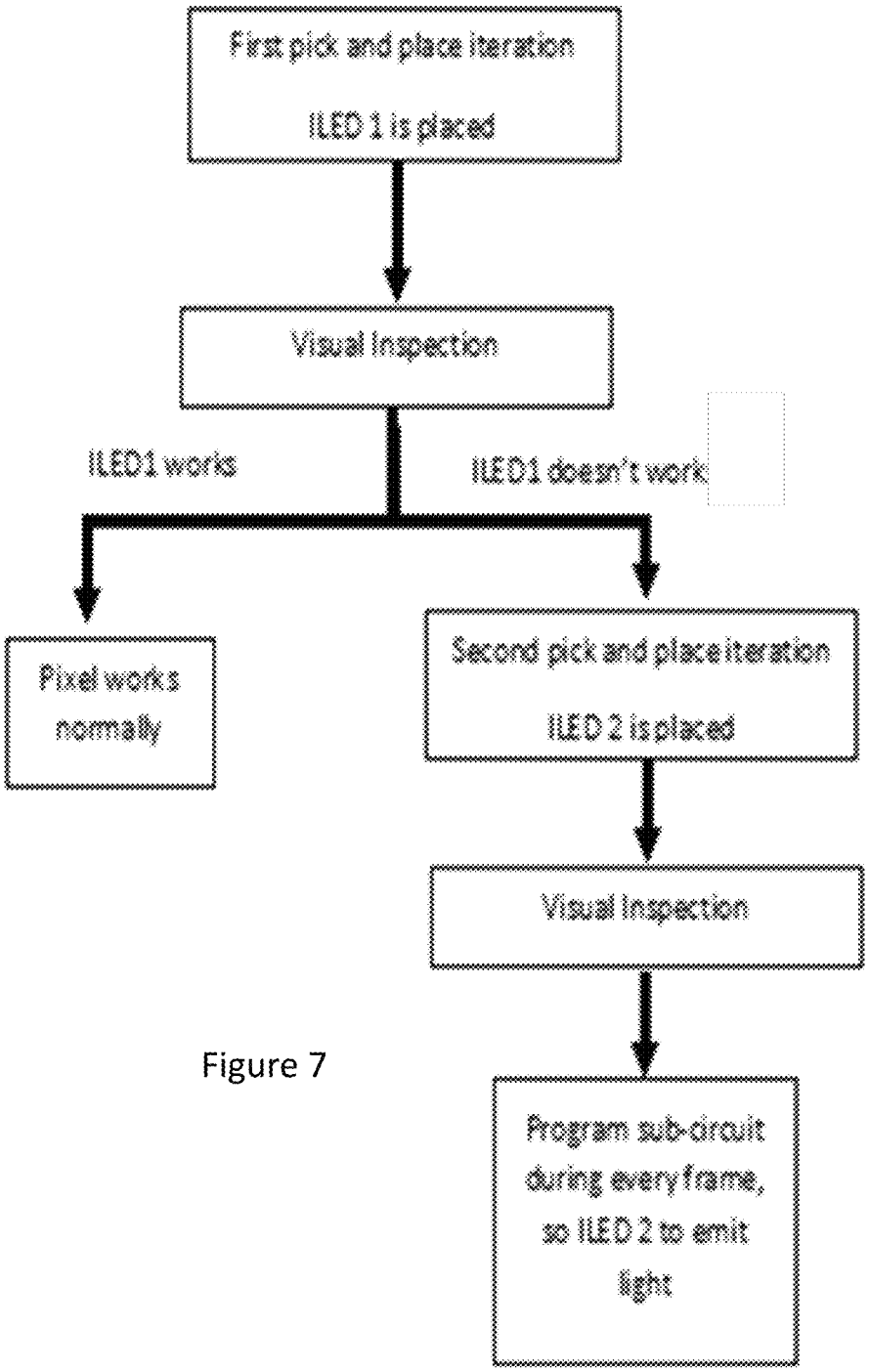
FIG. 7 shows a placement method for a display incorporating a cell such as shown in FIG. 6.

In one application, a matrix based on the cell design of FIG. 6 can be employed to improve yield. Referring to FIG. 7, initially, the whole panel is assembled with light emitting devices, for example, iLEDs, placed in sockets or locations corresponding to ILED1. As each iLED is discrete, this is typically performed using a first pick-and-place procedure. Once placement of these devices is completed, the panel is tested visually. With visual detection, all defective ILEDs are recognized and their location on the panel recorded. In this way, a panel map indicating defective ILEDs is generated and stored in a memory available to the matrix controller (not shown). This map will be used for the programming of the display when in operation.

A second pick-and-place places ILEDS in sockets or locations corresponding to ILED2 in cells where ILED1 has been identified as defective. (Note that the defective ILED does not need to be removed.) Also note that ILEDs chosen for placement in the second pick-and-place phase can be known good devices. For light emitting devices where say 95% of devices work, this means that only 5% need to be replaced and so this reduces the need to test devices before they are placed and yet still obtain higher manufacturing yield than the natural reliability of the devices would provide.

When the second pick-and-place procedure is completed, the panel is visually tested again. If any of the ILED2 locations still don't work, then these cells (along with other cells forming a pixel) can be converted into black pixels meaning that they will not emit light. Again, a panel map indicating cells containing two defective ILEDs can be generated and stored in a memory available to the matrix controller (not shown) and this map will be used for the programming of the display when in operation.

The selection of the appropriate Vdata value can be made using the above mentioned panel map(s), produced during the fabrication process and after the visual inspection. Each cell can be programmed individually so that, if the cell has a second iLED placed because the first was defective, in the programming phase, the Vdata value will be set less than Vbias (or at least the opposite to cells where the first iLED works). Similarly for "black" pixels, Vdata=Vbias value can be set during the programming phase for pixels indicated by the panel map to contain two defective ILEDs.

In another application, two different types of light emitting devices are placed in sockets or locations corresponding to iLED1 and iLED2 to enable the display to selectively operate in one of two modes. For example, iLED1 devices might have more focussed light emission characteristics whereas iLED2 devices might have more diffuse light emission. The panel controller can therefore swap between driving either the first set of devices or the second set of devices to swap between a display providing a narrow (private) viewing angle and a wider more accessible viewing angle.

In a still further application, again two different sets of light emitting devices can be placed in sockets corresponding to iLED1 and ilED2 and these can be selectively driven to provide a display which can selectively operate in one of a 2D display mode and a 3D display mode.

In each of these multi-mode embodiments, Vbias (or Vdata) can be a global signal and swapping this between one of two levels can change the panel from driving iLED1 to iLED2 within each cell.

In still further variants of the above described embodiments, the above principals can be extended to cell designs comprising more than two light emitting devices and appropriate switching circuitry to provide both threshold compensation and redundancy; redundancy and multi-mode operation; threshold compensation and multi-mode operation; or indeed threshold compensation, redundancy and multi-mode operation.

What is claimed is:

1. A display, comprising:

a matrix including a plurality of cells;

a scan driver coupled to the matrix to provide scan line signals to the plurality of cells; and a data driver connected to the matrix to provide data driver signals to the plurality of cells, wherein a cell of the plurality of cells includes:

a light emitting device;

a driving thin-film transistor (TFT) connected to the light emitting device to drive the light emitting device with a bias current, the driving TFT having a gate and a threshold voltage; and a circuit connected with the data driver and the gate of the driving TFT, the circuit configured to:

generate a gate voltage based on a voltage of the data driver signals from the data driver and the threshold voltage of the driving TFT; and provide the gate voltage to the gate of the driving TFT such that the bias current that drives the light emitting device is independent of the threshold voltage of the driving TFT;

wherein:

the circuit includes a first TFT connected in series with a second TFT;

the first TFT has a drain connected to a high supply line and the second TFT has a source connected to a low supply line;

a gate of the first TFT is selectively connected to a first data driver signal from the data driver under control of a scan line signal from the scan driver;

a gate of the second TFT is selectively connected to a second data driver signal from the data driver under control of the scan line signal; and the gate of the driving TFT is connected to a node joining the first and second TFTs.

2. The display of claim 1, wherein the circuit further includes:

a third TFT connecting the gate of the first TFT to the first data driver signal, a gate of the third TFT connected the scan driver to receive the scan signal line;

a fourth TFT connecting the gate of the second TFT to the second data driver signal, a gate of the fourth TFT connected to the scan driver to receive the scan line.

3. The display of claim 1, wherein:

the first data driver signal has a first voltage;

the second data driver signal has a second voltage different from the first voltage;

the first TFT has a first size; and the second TFT has a second size different from the first size.

4. The display of claim 3, wherein data driver sets the first and second voltages such that the first TFT and the second TFT each have a threshold voltage that is substantially the same as the threshold voltage of the driver TFT.

5. The display of claim 1, wherein the cell further includes a storage capacitance coupled to the node joining the gate of the driving TFT and the first and second TFTs.

6. The display of claim 1, wherein the data driver provides a pair of variable first and second data driver signals to each of the plurality of cells.

7. The display of claim 1, wherein the circuit generates the gate voltage in a first portion of a scan pulse period and provides the gate voltage to the gate of the driving TFT in a second portion of the scan pulse period.

8. A display, comprising:

a matrix including a plurality of cells;

a scan driver coupled to the matrix to provide scan line signals to the plurality of cells; and a data driver connected to the matrix to provide data driver signals to the plurality of cells, a cell of the plurality of cells including:

a first light emitting device;

a first driving thin-film transistor (TFT) connected to the first light emitting device to drive the first light emitting device, the first driving TFT having a first gate; and a second light emitting device;

a second driving TFT connected to the second light emitting device to drive the second light emitting device, the second driving TFT having a second gate, the second driving TFT being oppositely doped from the first driving TFT; and a circuit connected with the data driver and a node joining the first gate of the first driving TFT and the second gate of the second driving TFT, the circuit configured to:

generate a gate voltage based on a first voltage of a first data driver signal from the data driver and a second voltage of a second data driver signal from the data driver; and provide the gate voltage to the first gate of the first driving TFT and the second gate of the second driving TFT, the gate voltage causing the first driving TFT to drive the first light emitting device or causing the second TFT to drive the second light emitting device wherein:

the circuit includes a first TFT connected in series with a second TFT;

the first TFT has a drain connected to a high supply line and the second TFT has a source connected to a low supply line;

a gate of the first TFT is selectively connected to the first data driver signal from the data driver under control of a scan line signal from the scan driver;

a gate of the second TFT is selectively connected to the second data driver signal from the data driver under control of the scan line signal; and the first and second TFTs are connected to the node joining the first gate of the first driving TFT and the second gate of the second driving TFT.

9. The display of claim 8, wherein the circuit further includes:

a third TFT connecting the first gate of the first TFT to the first data driver signal, a third gate of the third TFT connected the scan driver to receive the scan signal line;

a fourth TFT connecting the second gate of the second TFT to the second data driver signal, a fourth gate of the fourth TFT connected to the scan driver to receive the scan line.

10. The display of claim 9, wherein the circuit further includes:

a first storage capacitance connected to the first gate of the first TFT; and a second storage capacitance connected to the second gate of the second TFT.

11. The display of claim 8, wherein the gate voltage causes the first TFT to drive the first light emitting device independent of a first threshold voltage of the first driving TFT or the second TFT to drive the second light emitting device independent of a second threshold voltage of the second driving TFT.

12. The display of claim 11, wherein the first TFT and the second TFT have the same size.

13. The display of claim 12, wherein the data driver sets the first and second voltages such that the first TFT and the second TFT each have a threshold voltage that is substantially the same as the first threshold voltage of the first driver TFT and the second threshold voltage of the second driver TFT.

14. The display of claim 8, wherein the data driver controls the voltage of the first data driver signals relative to the voltage of the second data driver signals to selectively drive the first light emitting device or the second light emitting device of the cell.

15. The display of claim 8, wherein the circuit generates the gate voltage in a first portion of a scan pulse period and provides the gate voltage to the first gate of the first driving TFT and the second gate of the second driving TFT in a second portion of the scan pulse period.

16. A method of populating a display, comprising:

placing first light emitting devices at first light emitting device locations within a matrix of the display, the matrix including a plurality of cells each being arranged to receive at least two light emitting devices;

testing the display to determine one or more cells containing a defective first light emitting device; and placing second light emitting devices at second light emitting device locations within the one or more cells determined to contain a defective first light emitting device subsequent to the testing, each of the one or more cells including circuitry that selectively activates a first light emitting device at a first light emitting device location or a second light emitting device at a second light emitting device location.

17. The method of claim 16, further comprising:

subsequent to placing the second light emitting devices at the second light emitting device locations of the one or more cells, testing the display to determine one or more second cells containing two defective light emitting devices; and storing locations of the one or more cells and the one or more second cells in a memory.

18. The method of claim 16, further comprising:

programming the circuitry of one or more second cells containing non-defective first light emitting devices at the first light emitting device locations to activate the non-defective first light emitting devices; and programming the circuitry of the one or more cells to activate the second light emitting devices at the second light emitting device locations.

* * * * *